United States Patent [19]

George

[11] 4,305,375

[45] Dec. 15, 1981

[54] GRATE FOR BURNING NEWSPAPERS

[76] Inventor: Wilfred R. George, 16 Bonita Ave., Piedmont, Calif. 94611

[21] Appl. No.: 110,832

[22] Filed: Jan. 9, 1980

[51] Int. Cl.[3] ..... F23H 13/00

[52] U.S. Cl. ..... 126/164; 126/152 B; 126/298; D7/207

[58] Field of Search ..... 126/164, 165, 152 B, 126/152 R, 298; 211/60 G, 60 R, 60 T, 62; D7/207; D23/135, 96

[56] References Cited

U.S. PATENT DOCUMENTS 710,790 10/1902 Magerhans ..... 211/62

1,462,615 7/1923 Noble ..... 211/62

3,838,679 10/1974 Welch ..... 126/165

*Primary Examiner*—James C. Yeung

*Attorney, Agent, or Firm*—Flehr, Hohbach, Test, Albritton & Herbert

[57] ABSTRACT

A grate for burning newspapers having a structure formed of a non-combustible material and a stand formed of a non-combustiblematerial for supporting the structure in an elevated position. The structure comprises members formed of a plurality of spaced apart adjacent recesses formed in such a manner as to receive bundles of newspapers in each of the recesses. The newspapers when disposed in the recesses form vertically disposed paths for the flow of air to provide a chimney effect during burning of the newspapers.

5 Claims, 10 Drawing Figures

GRATE FOR BURNING NEWSPAPERS

This invention relates to grates for burning newspapers, junk mail and similar organic material and to such grates which are particularly suited for use in fireplaces and Franklin type stoves.

In the burning of newspapers in fireplaces in the past, it has been the practice either to place the newspapers in a flattened out positions in the fireplace or on a conventional log burning grate in the fireplace. The burning of newspapers in this manner has been relatively difficult and dangerous because large portions of the newspaper as they are burning have the tendency to float upwardly with the hot air and can float into the room or up into the chimney while still burning and thereby possibly cause numerous fire hazards.

With the advent of higher fuel prices for firewood, there is an increased need to utilize newspapers for fuel to provide heating and also to provide an attractive fire in the fireplace. This makes it possible to reduce the use of logs and thereby save trees. There is therefore a need to provide the structure in the form of a grate and a method which makes it possible to readily burn newspapers.

In general, it is an object of the present invention to provide a grate and a method for burning newspapers so that the newspapers can be utilized as an energy source.

Another object of the invention is to provide a grate and method of the above character which can be utilized in numerous applications where heat is required.

Another object of the invention is to provide a grate and method of the above character which is particularly adapted for use in fireplaces.

Another object of the invention is to provide a grate and method of the above character in which the grate for burning newspapers can be utilized in conjunction with a conventional grate provided in a fireplace.

Another object of the invention is to provide a grate and method of the above character which permits a quantity of newspapers to burn over a substantial period of time.

Another object of the invention is to provide a grate and method of the above character in which the newspapers can be burned without large portions thereof floating free during burning.

Another object of the invention is to provide a grate and method of the above character in which the newspapers utilized in conjunction therewith will burn out completely within a predetermined period of time.

Another object of the invention is to provide a grate and method of the above character in which a fire is easy to light and fast to start with no danger of producing sparks which would pop into the room.

Another object of the invention is to provide a grate and method of the above character in which at least three rolls or bundles are carried by the grate whereby adjacent hot surfaces are provided to cause radiation upon each other to encourage burning.

Another object of the invention is to provide a grate and method of the above character in which a chimmney effect is provided within the papers in the grate to facilitate burning of the same.

Another object of the invention is to provide a grate and method of the above character which provides a fire which is pleasant to watch.

Additional advantages and features of the invention will appear from the following description in which the preferred embodiments are set forth in detail in conjunction with the accompanying drawings.

Figure 1:
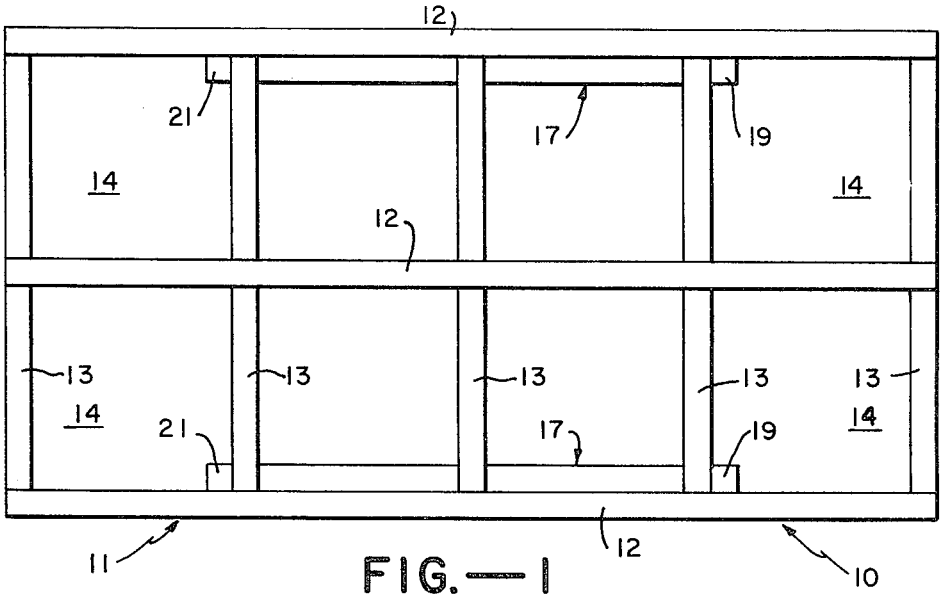
FIG. 1 is a top plan view of a grate incorporating the present invention.

In general, the grate for burning newspapers comprises a structure formed of non-combustible material and foot-like means for supporting the structure in an elevated position. The structure is formed to provide a plurality of recesses for newspapers to be burned.

A grate for burning newspapers incorporating the present invention is shown in FIG. 1-5. As shown therein, it consists of a structure 11 which is formed of a noncombustible material. As shown, the structure is formed of three longitudinally extending spaced apart bars 12, which lie in a generally horizontal plane. A plurality of transversly extending spaced apart parallel bars 13 are also provided which underlie the bars 12 and also lie in a generally horizontally plane. The bars 12 and 13 are secured to each other by a suitable means such as welding. As noted in the embodiment of the grate shown in FIG. 1-5, three of the longitudinally extending bars 12 and five of the transversely extending bars 13 are provided to form a plurality of rectangular holes or recesses 14. Thus as shown there are provided two rows of recesses 14 extending in a longitudinal direction and four rows of recesses 14 extending in a transverse direction. It should be appreciated the recesses of 14 can be formed in any suitable manner. For example, the bars 13 rather than underlying the bars 12 can overlie the bars 12. The bars 12 and 13 are formed of a suitable material such as bar steel. Although bar steel having a square cross-section has been utilized as shown in the drawings, there are other types of bars such as diamond bars and modified diamond bars which can be utilized if desired.

Means is provided for supporting the structure 11 in an elevated position and it consists of a stand 16 also formed of a non-combustible material. The stand 16 as shown in FIG. 1-5 consists of a pair of U-shaped members 17 formed of the same bar stock as the bars 12 and 13. Each U-shaped members has a bottom immediate portion 18 which provides a substantially planar surface which is adapted to rest upon another planar surface. Each of the U-shaped members 17 is also provided with upstanding leg portions 19 and 21. The upper extremities of the upstanding leg portions 19 and 21 are secured to the structure 11 by suitable means such as welding. Thus as shown in the drawings, the leg portions 19 and 22 are secured to the transversely extending bars 13 and also to the two outer longitudinally extending bars 12 in such a manner so that the U-shaped members 17 depend vertically from the horizontal structure 11 and lie in spaced parallel planes which are perpendicular to the structure 11 and parallel to the longitudinal bars or members 12. In this manner, the two U-shaped members form the stand which can be seated upon any generally horizontal planar surface to thereby support the structure 11 at a predetermined distance above the planar surface. A reinforcing bar 22 is provided and has its opposite ends secured to the upper surfaces of the bottom portions 18 of the U-shaped members 17 by a suitable means such as welding.

Figure 2:
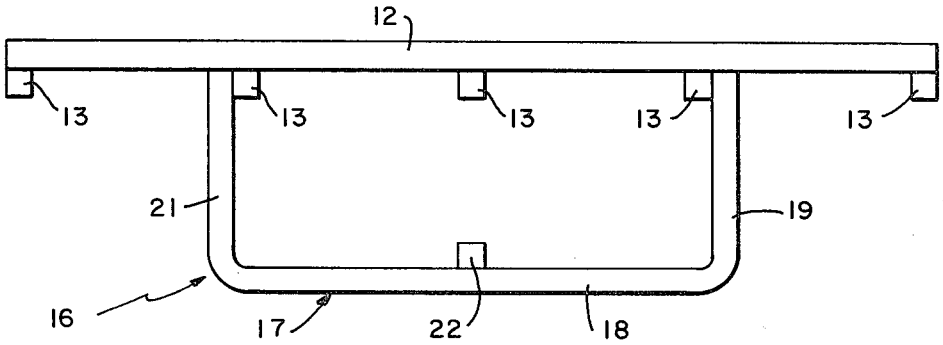
FIG. 2 is a front elevational view of the grate shown in FIG. 1.
Figure 3:
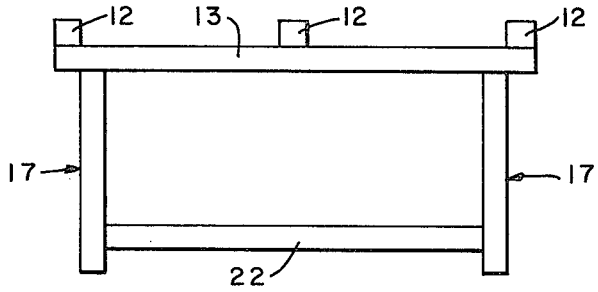
FIG. 3 is a side elevational view of the grate shown in FIG. 1.

Use of the grate shown in FIGS. 1, 2 and 3 may now be briefly described as follows. Let it be assumed that it is desired to utilize the grate in a conventional log-burning fireplace. When such is the case, the grate can be placed on the generally horizontal surface provided in the fireplace or alternatively it can be positioned upon a conventional log-burning fireplace grate 26. Such fireplace grates as well known to those skilled in the art conventionally consists of a pair of U-shaped members 27 formed of a diamond bar stock from which the legs of the members 27 depend downwardly and rest upon the flat surface of the fireplace. The U-shaped members 27 are spaced apart and are parallel. A plurality of parallel spaced apart diamond-shaped bars 28 are mounted upon the members 27 and extend transversely of the members 27. The bars 28 are curved as shown to provide a concave or dished surface for holding fireplace logs which are conventionally burned in the fireplaces.

Figure 4:
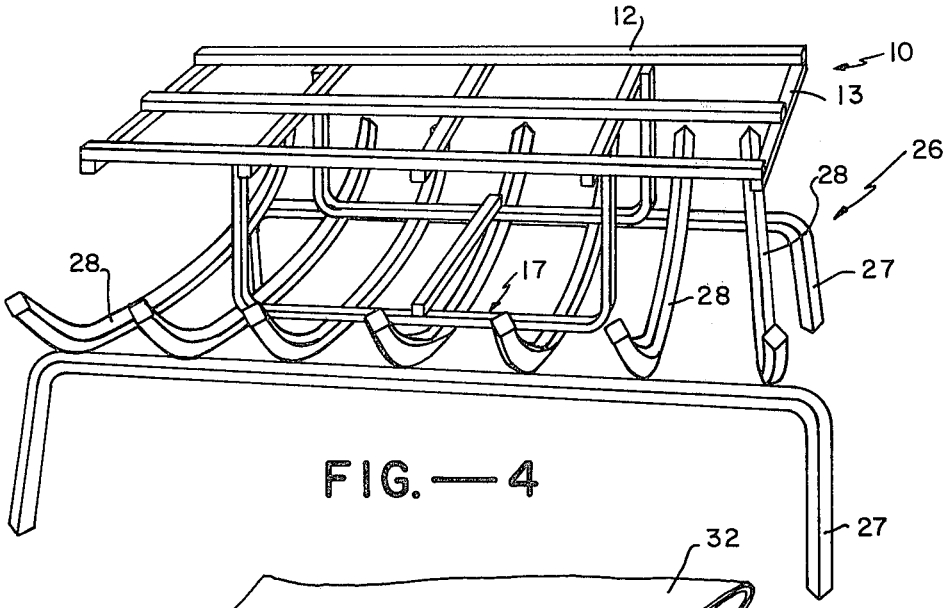
FIG. 4 is a perspective view showing the grate shown in FIGS. 1, 2 and 3 mounted upon a conventional log-burning fireplace grate.

The grate 10 of my invention is constructed so that it can be positioned upon a conventional fireplace grate 26 as shown particularly in FIG. 4 in which the U-shaped members 17 rest upon and extend transversly of the bars 28 of the fireplace grate 26. When this is the case, the structure 11 is supported in a horizontal plane above the floor or bottom surface of the fireplace and also above the fireplace grate 26.

Figure 5:
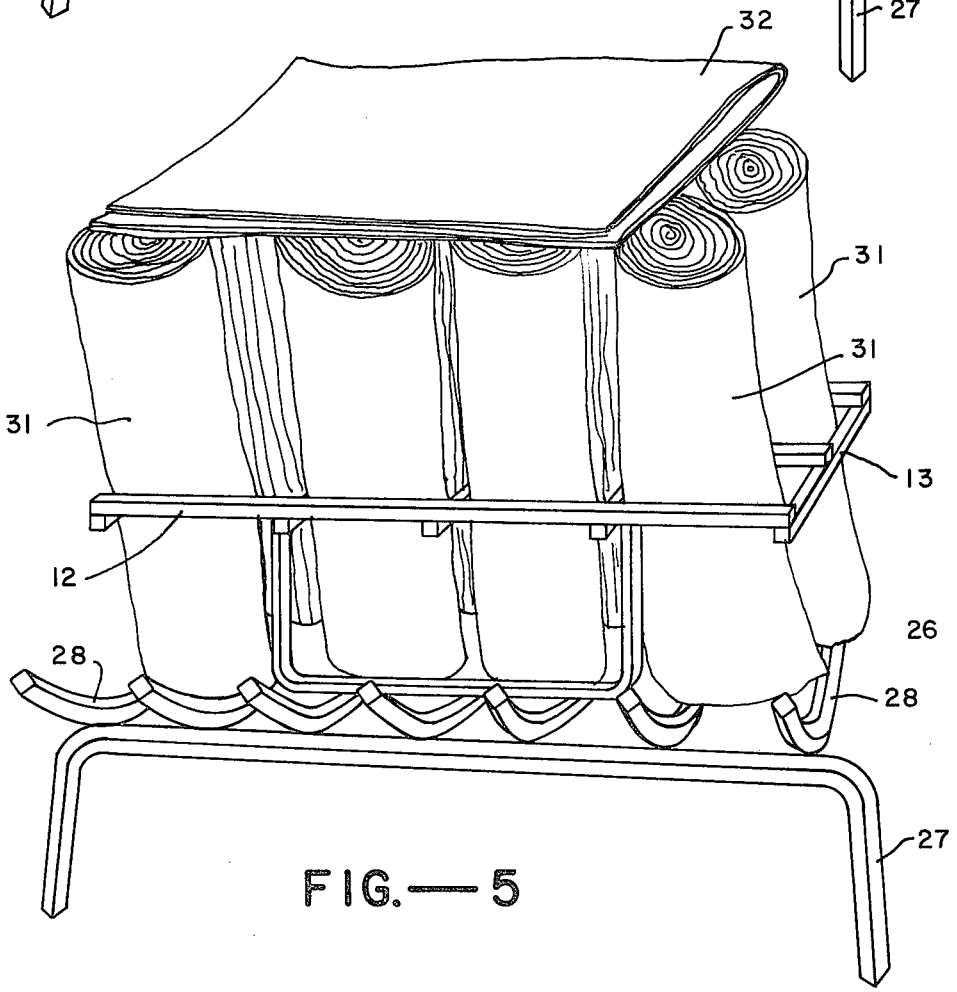
FIG. 5 is another perspective similar to that shown in FIG. 4, but showing the grate loaded with rolls of newspapers ready to be ignited.
Figure 6:
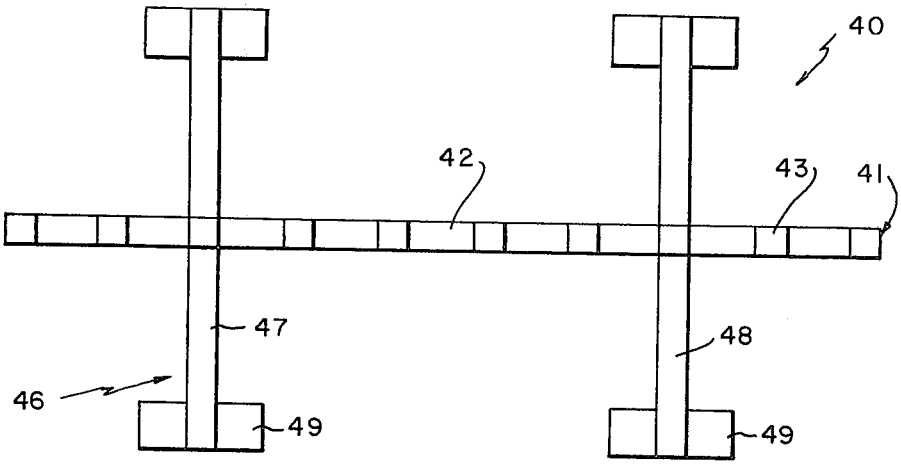
FIG. 6 is a top plan view of another embodiment my fireplace grate incorporating the present invention.
Figure 7:
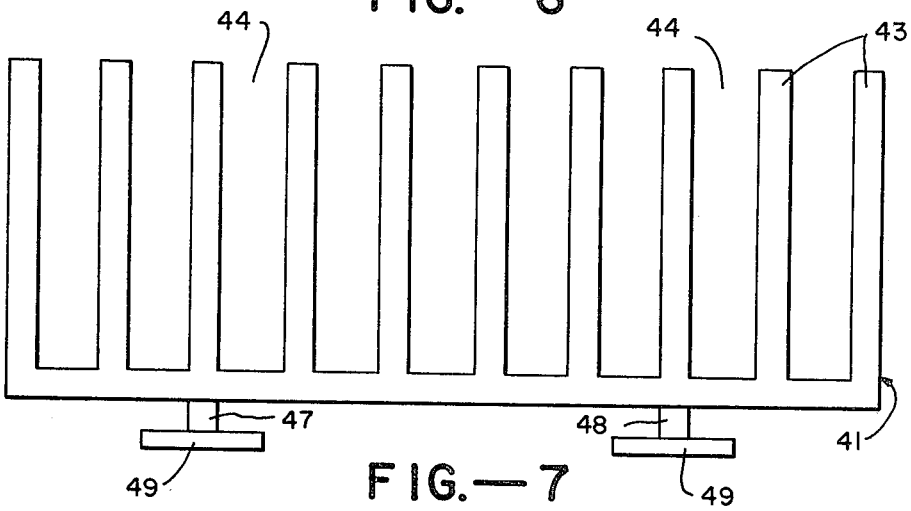
FIG. 7 is a front elevational view of the grate shown in FIG. 6.
Figure 8:
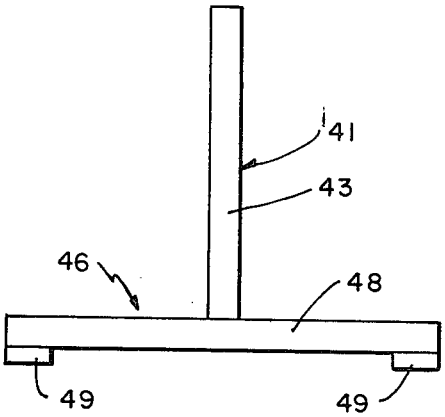
FIG. 8 is an end elevational view of the grate shown in FIG. 6.

As shown, the grate 10 is positioned on the fireplace grate 26 so that its long dimension is facing out into the room. A stack of newspapers approximately 4–6 inches in thickness and generally having dimensions of 11 by 17 inches is taken and positioned adjacent the fireplace. Newspapers having a thickness of approximately $\frac{1}{2}$ to $\frac{3}{4}$ of an inch are then taken and rolled into a cylindrical configuration or roll 31 and placed in one of the recesses 14 in such a manner so that the roll 31 has its axis extending in a generally vertical direction as shown in FIG. 5. This procedure is continued until rolls 31 of newspaper are positioned in each of the openings or recesses 14. To facilitate loading, preferably, the recesses in the rear can be filled first and thereafter the recesses in the front. Thereafter a double page folded newspaper 32 is then placed on the top surfaces of the rolls 31 as shown in FIG. 5. The newspapers are now ready for lighting.

Assuming it is now desired to start a fire in the fireplace, the damper in the fireplace is opened and the front edge of the top generally planar newspaper 32 is lit with one match along one edge of the same. The fireplace screen is now put in place. As the newspaper 32 burns, it will ignite the top surfaces of the rolls 31 and they will commence burning. Since the rolls 31 are disposed vertically, they provide vertically disposed paths or minature chimmneys to provide drafts for facilitating burning of the newspaper rolls. Also by being in close proximities to each other in the grate, the rolls 31 as they burn provide radiating surfaces which encourage burning. The rapidity of the burning of the rolls can be controlled by the tightness of the rolls 31. When relative rapid fires are desired, rolls of fewer newspapers can be placed in each space and the rolls can be looser. Conversely, when a slower longer lasting fire is desired, more newspapers can be placed in each roll and the newspapers rolled more tightly to provide a tight compact roll.

It has been found that when newspapers are rolled in this manner and are positioned in the grate 10 they will burn for a relatively long period of time as for example 1 and $\frac{1}{2}$ to 2 hours before refueling. It has been found, by use of the grate of my invention, the newspapers will burn completely to a very fine light ash which will not continued smoking. Thus as soon as the newspapers have been burned, the damper of the fireplace can be closed without the necessity of leaving the damper open during the night to permit smoke to escape which at the same time takes heated air out of the home.

If it is desired to have a longer fire, as the rolls burn out, new paper rolls can be inserted into the empty spaces. Since the bars forming the grate 10 are still hot, the bars will help to ignite the paper rolls so that a continuous fire can be provided if desired.

By utilization of the grate of my invention, it can be seen that newspapers and other papers such as junk mail and even magazines and other organic matter can be burned in the grate to provide useful heat in the home to thereby conserve expensive fossil fuels. The burning of the newspapers in this manner also eliminates a disposal problem. The newspapers can be burned periodically as they pile up in the home.

Construction of the grate 10 is such that it can be readily placed on existing log-burning fireplace grate and after the newspapers have been burned, it can be readily removed so that the logs can be again burned in the fireplace. Although the grate 10 has been described as being utilized in connection with a conventional fireplace grate 26, it should be appreciated that the grate can be utilized in the fireplace without the use of a conventional fireplace grate. Wood logs can be laid horizontally on top of the newspaper grate. Such logs will readily ignite from the newspaper fire.

Although the grate 10 as been described above for use in connection with a conventional fireplace in a home, it should be appreciated that by providing grates of various sizes such grates can be utilized in connection with stoves, furnaces, hot water systems, swimming pool heaters, hot tubs and the like where heat is required. Thus, the grate 10 makes it possible to utilize alternative fuels for energy. Newspapers, other paper, junk mail and other hydrocarbon material waste can be burned in such a grate to obtain desired heat. In addition, the grate provides a means for readily burning newspapers without large pieces of same floating away and creating fire hazards. In addition, it has been found that the grate can be provided for cooking out doors.

Another embodiment for the grate for burning newspapers is shown in FIGS. 6–10. The grate 40 consists of a structure 41 which is formed of a non-combustible material and which extends in a generally vertical direction. The structure 41 is formed of a suitable bar material such as steel, wrought iron or cast iron. The bar 42 extends in a generally horizontal direction. A plurality of spaced apart parallel vertical extending bars 43 are secured to the bar 42 in a suitable manner such as welding. As shown particularly in FIG. 6, the bars 42 and 43 lie in the same vertical plane. The tops of the bars 43 also lie in a horizontal plane. A stand 46 is provided for supporting the structure 41 in a raised or elevated position. The stand 46 consists of a pair of parallel bars 47 and 48 which spaced apart lie in a horizontal plane. They are secured to the lower surface of the bar 42 by suitable means such as welding and extend in a direction at right angles to the bar 42. Plates 49 are secured to the outer extremities of the bars 47 and 48 by suitable means such as welding. The plates 49 underlie the bars 47 and 48 are adapted to rest upon a planar surface.

Use of the grate 40 may now be briefly described as follows.

Figure 9:
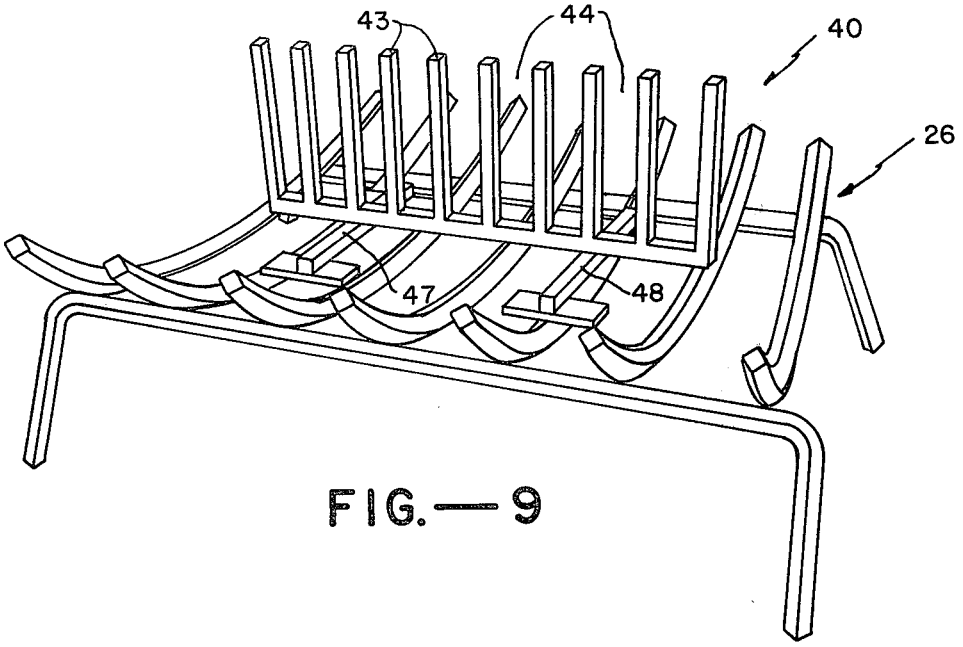
FIG. 9 is a perspective view showing the grate as shown in FIGS. 6, 7 and 8 and mounted upon a conventional fireplace log burning grate.
Figure 10:
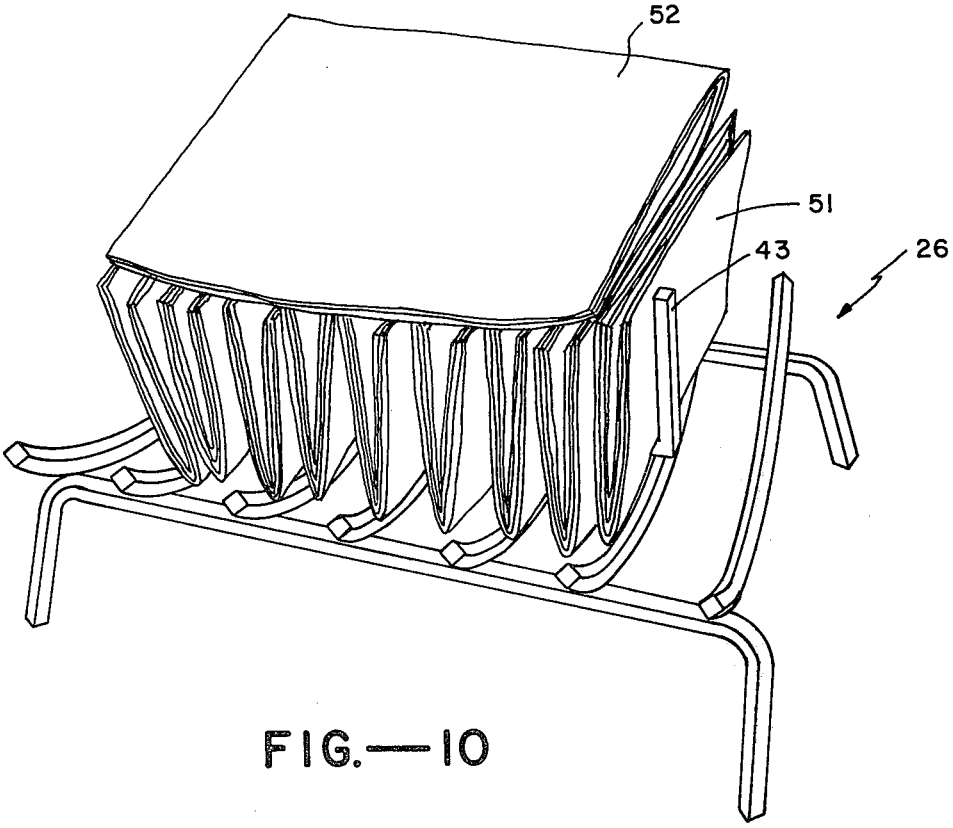
FIG. 10 is a perspective view similar to FIG. 9 but showing the same loaded with the newspapers ready to be ignited.

As shown in FIGS. 9 and 10, this grate 40 also can be utilized with a conventional fireplace grate 26 of the type hereinbefore described. The vertically extending bars 43 which are spaced apart provide a plurality of recesses 44 for receiving newspapers. After the grate 40 has been placed upon the fireplace grate 26, a stack of newspapers is taken. However, rather then rolling them as in connection with the grate of the previous embodiments the stacks of newspapers are taken in normally folded positions and inserted into the recesses or spaces 44 provided between the upstanding vertical bars 43. The newspapers are properly positioned so the bottoms of the V's formed by the newspapers are on the bottom. The length of time which the fire is to burn can be controlled by the number of newspapers which are positioned in each of the slots or recesses 44. Thus, for a longer burning fire, a larger group of newspapers can be positioned in a slot or space and when a shorter burning fire is desired, fewer newspapers can be positioned in each of the spaces or slots. All of the spaces or slots are filled with packets or bundles of newspapers 51 until they are all or substantially all filled. Thereafter, a double sheet of newspaper 52 is folded and positioned on top of the packets or bundles 51 provided in the spaces 44. When it is desired to light the fire, the damper in the fireplace is opened and the front edge of the newspaper 52 is lit. Thus the burning of the newspaper 52 will ignite the packets or bundles 51 of newspapers provided in the spaces 44. A chimmney effect is provided by the vertically arranged packets or bundles or papers provided in these spaces 44 so as to facilitate burning of the newspapers in a clean manner. In general, the grate 40 has many of the same advantages as the grate 10 in the burning of newspapers with the principal difference being that longer burning can be obtained by tightly rolled newspapers than with tightly folded newspapers.

Again the grate 40 can also be utilized in different applications of the type disclosed for which the grate 10 can be utilized. It also can be utilized without a fireplace grate in a fireplace.

The construction of the newspaper grates of the present invention is relatively simple so that the grate can be manufactured at low cost. The initial cost of a grate can be recovered in a relatively short period of time by the saving of energy which is provided by the burning of newspapers particularly in view of the high present costs of fossil fuels and the likely increasing costs of the same. The grate can be stored when not in use. It can be fabricated in various sizes. By way of example, grates of the present invention had a length of approximately 20 by 10 inches and a height of approximately 5 inches.

What is claimed is:

1. In a grate for burning newspapers, a structure formed of a non-combustable material and a stand formed of a non-combustable material for supporting the structure in an elevated position, the structure comprising elongate bar-like members forming a plurality of spaced apart adjacent recesses formed into at least two adjacent parallel rows, the recesses being generally rectangular in configuration and lying in a horizontal plane and being adapted to receive bundles of newspapers which are formed into cylindrical rolls, the recesses being defined by relatively straight elongate portions of said elongate bar-like members, the bar-like members being joined together so that the bar-like members forming adjacent recesses support each other, the newspapers when disposed in the recesses forming vertically disposed paths for the flow of air to provide a chimney effect during burning of the newspapers.

2. A grate as in claim 1 wherein said structure is provided with a plurality of spaced apart parallel longitudinally extending bars and spaced apart parallel transversly extending bars secured to the longitudinally extending bars and lying in a generaly horizontal plane to provide the horizontally disposed spaces.

3. A grate as in claim 2 wherein the stand is formed of a pair of spaced apart U-shaped members in which the lower extremities of U-shaped members lie in a horizontal plane and the upstanding leg portions of the U-shaped members are secured to the structure.

4. In the combination of a grate for burning newspapers and a fireplace grate, a fireplace grate comprising a stand and a plurality of curved members carried by the stand forming a concave surface for receiving logs and the like, the grate for burning newspapers comprising a structure formed of a non-combustable material and a stand secured to the structure for supporting the structure in an elevated position, the structure including elongated bar-like members forming a plurality of spaced apart adjacent recesses formed into at least two adjacent parallel rows, the recesses being generally rectangular in configuration and lying in a horizontal plane and being adapted to receive bundles of newspapers which are formed into cylindrical rolls, the recesses being defined by relatively straight elongate portions of said elongate bar-like members, the bar-like members being joined together so that the bar-like members forming adjacent recesses support each other, the newspapers when disposed in the recesses forming vartically disposed paths for the flow of air to provide a chimney effect during burning of the newspapers, the grate for receiving newspapers being disposed upon and resting upon the fireplace grate with the stand of the grate for burning newspapers resting upon the curved members of the fireplace grate.

5. A combination as in claim 4 wherein said stand is provided with members which extend transversely of the curved members of the fireplace grate.

* * * * *